US008246242B2

(12) United States Patent
Sato et al.

(10) Patent No.: US 8,246,242 B2
(45) Date of Patent: Aug. 21, 2012

(54) STIRRING BLADE AND SEALED STIRRING APPARATUS

(75) Inventors: Makoto Sato, Toda (JP); Yoshikazu Kato, Toda (JP); Hisayuki Kanamori, Toda (JP); Takatsugu Sekizuka, Toda (JP)

(73) Assignee: Satake Chemical Equipment Mfg Ltd., Osaka (JP)

( * ) Notice: Subject to any disclaimer, the term of this patent is extended or adjusted under 35 U.S.C. 154(b) by 300 days.

(21) Appl. No.: 12/705,055

(22) Filed: Feb. 12, 2010

(65) Prior Publication Data

US 2011/0026361 A1 Feb. 3, 2011

(30) Foreign Application Priority Data

Aug. 3, 2009 (JP) ..... 2009-180846

(51) Int. Cl.
*B01F 11/00* (2006.01)

(52) U.S. Cl. ..... 366/256; 366/332

(58) Field of Classification Search ..... 366/256–260, 366/332–334, 347, 314–317; 241/282.1
See application file for complete search history.

(56) References Cited

U.S. PATENT DOCUMENTS

| | | | | | |
|---|---|---|---|---|---|
| 66,015 | A | * | 6/1867 | Gaston | 366/256 |
| 140,445 | A | * | 7/1873 | Thompson et al. | 366/259 |
| 408,126 | A | * | 7/1889 | Mitchum | 366/260 |
| 435,369 | A | * | 8/1890 | Sheets et al. | 366/257 |
| 623,668 | A | * | 4/1899 | Holt | 366/252 |
| 763,139 | A | * | 6/1904 | Yarbrough | 366/256 |
| 2,615,692 | A | * | 10/1952 | Muller | 366/273 |

FOREIGN PATENT DOCUMENTS

JP A-2004-243161 9/2004

* cited by examiner

*Primary Examiner* — David Sorkin
(74) *Attorney, Agent, or Firm* — Oliff & Berridge, PLC

(57) ABSTRACT

An up/down movable diaphragm is disposed to an upper surface portion of a stirring vessel so as to airtightly cover the upper surface portion, a drive shaft passing through the diaphragm is fixed and vertically disposed to the diaphragm, and a stirring blade coupled with and fixed to a lower end portion of the drive shaft so as to be orthogonal thereto is composed of a laterally long and oval sheet-shaped member having a major axis and a minor axis passing through a center thereof, and a stirring is performed by moving the stirring blade up and down. With this arrangement, there are provided a stirring blade and a stirring apparatus which do not apply a strong shearing force to a stirring liquid, do not have an anxiety of polluting the stirring liquid, and can sufficiently fluidize, mix, disperse, and homogenize the stirring liquid in a stirring blade and a stirring apparatus for performing a stirring in fields of medicine and food.

4 Claims, 9 Drawing Sheets

STIRRING BLADE AND SEALED STIRRING APPARATUS

BACKGROUND OF THE INVENTION

1. Field of the Invention

The invention relates to a stirring blade optimum for stirring a culture liquid for medicine and the like and a sealed stirring apparatus using the stirring blade.

2. Description of the Related Art

Conventional stirring blades and stirring apparatuses generate a liquid flow by rotating a stirring blade by rotating a motor or perform a stirring by moving a disc blade up and down at a large stroke.

However, in a culture liquid and the like in a field of medicine, a rotary stirring is not preferably because it damages fungus bodies, and further a stirring apparatus having a rotary sliding portion has a problem in that it is not preferable due to a problem of a contamination (pollution) of a culture liquid.

To prevent a leakage of a liquid to be stirred and its vapor from a stirring vessel and entering of foreign substances from the outside, Japanese Patent No. 4316251 granted to the applicant discloses a sealed stirring apparatus having a stirring vessel, an up/down movable diaphragm disposed on an upper surface portion of the stirring vessel so as to airtightly cover the upper surface portion, a rod member fixed and vertically disposed to the diaphragm so as to pass therethrough, a stirring blade fixed and vertically disposed to a lower end portion of the rod member, a baffle plate disposed on an inside surface of the stirring vessel in a longitudinal direction, and a plurality of flat plate blades for the stirring blade standing on upper and lower surfaces of a disc plate in an oblique radial state to generate a discharge flow in an obliquely radially external direction, wherein an inside of the stirring vessel is stirred by moving the stirring blade up and down.

Although the sealed stirring apparatus disclosed in Japanese Patent No. 4316251 forms a good swirling flow in the stirring vessel by an up/down reciprocating motion of the stirring blade, a flow in an up-down direction is not perfect.

Further, the conventional stirring blades, which perform a stirring by moving the disc blade up and down at the large stroke, have a problem from an operating viewpoint and a structural viewpoint (structure of a sealed portion) although they forcibly promote, mixing.

An object of the invention, which was made to overcome the above problems, is to provide a stirring blade preferable mainly to a stirring in fields of medicine and food and a stirring apparatus using the stirring blade, wherein the stirring blade has such a structure that a stirring liquid in a stirring vessel is not strongly subjected to a shearing action and is sufficiently mixed, dispersed, and homogenized by perfectly fluidizing the stirring liquid in an up/down direction and is prevented from being polluted.

SUMMARY OF THE INVENTION

According to the invention for achieving the above object, a blade member as a stirring blade, which is coupled with and fixed to a lower end surface portion of an up/down reciprocating shaft so as to orthogonal thereto, is composed of a laterally long sheet-shaped member having a major axis and a minor axis passing through a center thereof, a stirring apparatus has an up/down movable diaphragm or a bellows disposed on an upper surface portion of a stirring vessel so as to airtightly cover the upper surface portion, a drive shaft passing through the diaphragm or the bellows is fixed and vertically disposed to the diaphragm or the bellows, the stirring blade coupled with and fixed to the lower portion of the drive shaft so as to be orthogonal thereto is composed of a laterally long sheet-shaped member having a major axis and a minor axis passing through a center thereof, and an inside of the stirring vessel is stirred by moving the stirring blade up and down.

The invention has an advantage of providing a stirring blade and a stirring apparatus which can sufficiently stir, mix, disperse, and homogenize a target liquid with a low shearing action, moreover has a completely sealed structure so that a stirring liquid is not polluted and can be optimally used in a field of a medicine, a field of food, and the like.

DESCRIPTION OF THE PREFERRED EMBODIMENTS

Embodiments of the invention will be described below.

Embodiment 1

An embodiment 1 of the invention will be explained referring to FIGS. 1 to 6.

Figure 1:
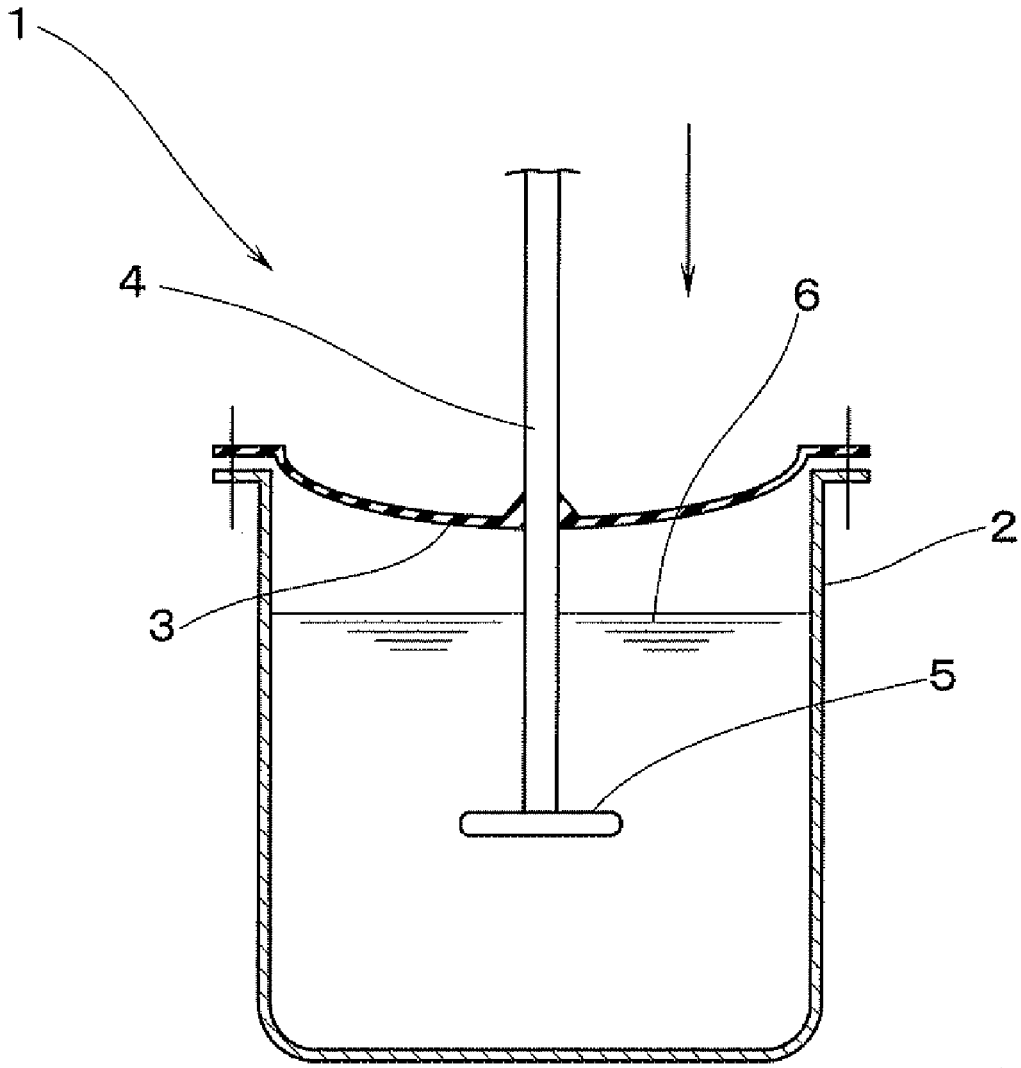
FIG. 1 is a longitudinal sectional view of a sealed stirring apparatus of an embodiment 1 of the invention.

FIG. 1 is a longitudinal sectional view of a sealed stirring apparatus 1 using a stirring blade of the invention.

Reference numeral 2 denotes a stirring vessel having a cylindrical barrel portion.

Reference numeral 3 denotes a diaphragm composed of a flexible membrane member of rubber and the like and airtightly disposed so as to cover an upper end opening portion of the stirring vessel 2.

Reference numeral 4 denotes a drive shaft which is vertically disposed to a not shown up/down moving device, for example, a reciprocating drive motor at an upper portion. The drive shaft 4 passes through the diaphragm 3 at an intermediate portion thereof as well as is airtightly fixed to the diaphragm 3.

Figure 2:
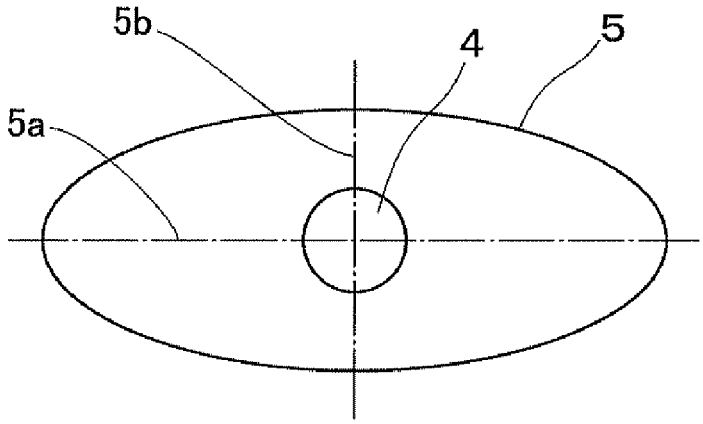
FIG. 2 is a plan view of a stirring blade of the sealed stirring apparatus.

Reference numeral 5 denotes a stirring blade composed of an oval sheet-shaped member and coupled with and fix to a lower end portion of the drive shaft 4 so as to be orthogonal thereto as shown in FIG. 2.

In FIG. 2, reference numeral 5*a* denotes a major axis of the oval stirring blade 5, and reference numeral 5*b* denotes a minor axis thereof.

Reference numeral 6 denotes a stirring liquid in the stirring vessel.

Next, an operation/working effect of the stirring blade 5 and the sealed stirring apparatus 1 of the embodiment 1 will be explained.

The sealed stirring apparatus 1 is suitable for stirring a stirring liquid such as a living substance culture liquid which must be prevented from being externally polluted and stirred and mixed by a low shearing action.

The drive shaft 4 and the stirring blade 5 disposed to the lower portion thereof are vertically inserted into the stirring liquid 6, an upper surface of the stirring vessel 2 is sealed by the diaphragm 3, and a stirring (vertical vibration stirring) is performed by vertically reciprocating the drive shaft 4 and the stirring blade 5 disposed to the lower end portion of the drive shaft 4.

Since the stirring blade 5 of the embodiment 1 is composed of the laterally long sheet-shaped blade and an up/down flow path is secured on a side the blade, a large circulating flow accompanied with a vertical flow and a swirling flow which are much larger than those of conventional disc type stirring blade can be generated.

Figure 4:
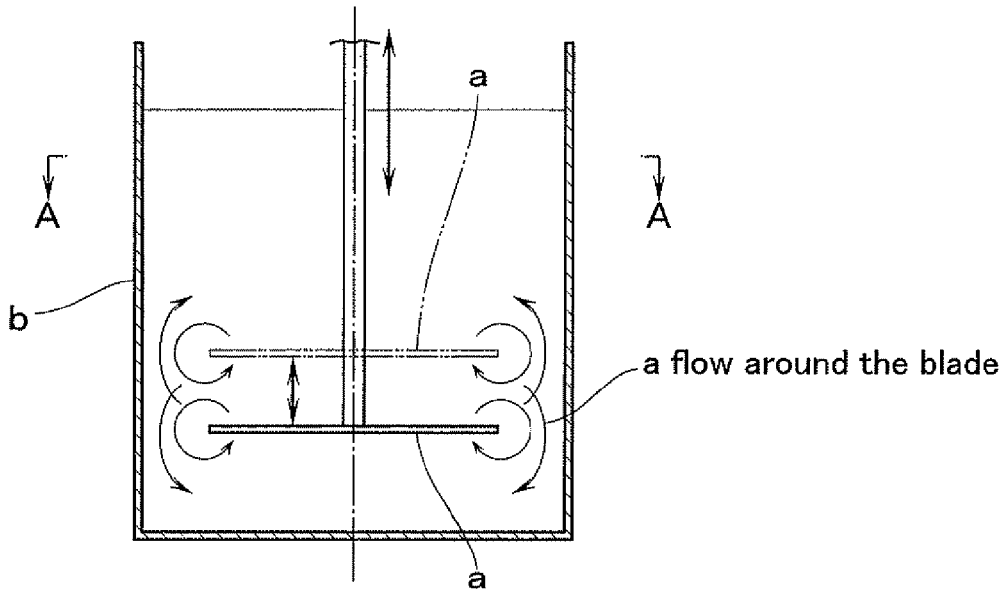
FIG. 4 is an explanatory view showing a flow pattern of an up/down vibration stirring using a conventional disc type stirring blade.

FIG. 4 shows a flow pattern of an up/down vibration stirring using a conventional disc type stirring blade.

Figure 5:
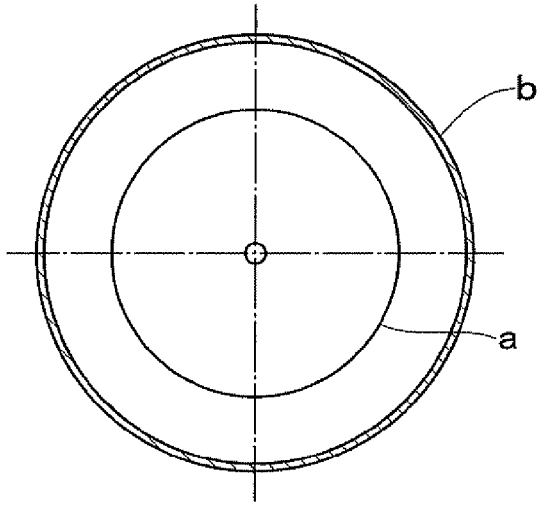
FIG. 5 is a sectional view taken along the lie A-A of FIG. 4.

The conventional disc type stirring blade a has a problem in that it generates a less amount of an up/down flow and is unlike to generate a swirling component. More specifically, as shown in FIG. 5, a flow can be obtained only around the blade having the same interval between an outside edge of the disc type stirring blade a and an inside peripheral surface of the stirring vessel b, and a large up/down stream cannot be generated in the overall stirring vessel.

When an up/down vibration of the disc type stirring blade a has a small stroke, the blade a has also a problem in that it cannot generate an up/down stream.

Figure 6:
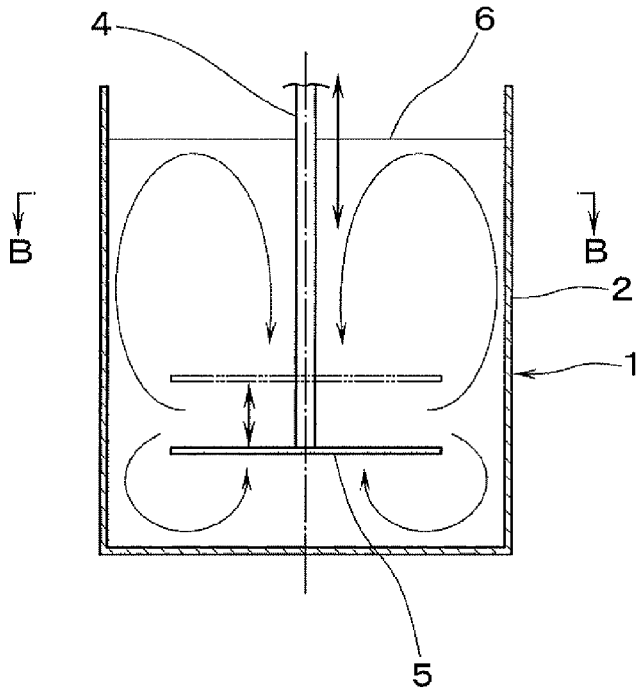
FIG. 6 is an explanatory view showing a flow pattern of an up/down vibration stirring of the embodiment 1 of the invention.
Figure 7:
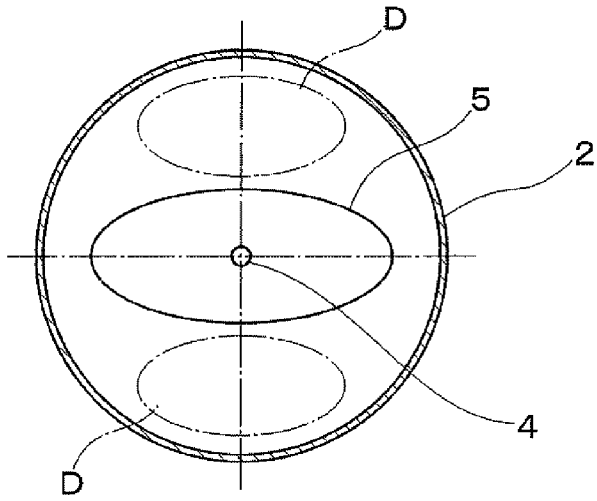
FIG. 7 is a sectional view taken along the lie B-B of FIG. 6.

In contrast, since the stirring apparatus 1 using the stirring blade 5 of the embodiment has up/down stream reinforcing regions D formed externally of the minor axis 5*b* portion of the stirring blade 5 as shown in FIG. 7, the stirring apparatus 1 can obtain a large up/down stream and a swirling flow accompanied therewith as shown in FIG. 6.

In particular, even if a stirring liquid has a high viscosity, since the stirring blade 5 can exhibit a very excellent mixing performance by an up/down vibration of a small stroke, the stirring blade 5 is advantageous in that it can be operated by a very small drive force in comparison with a case of using the conventional disc type stirring blade a.

Figure 3:
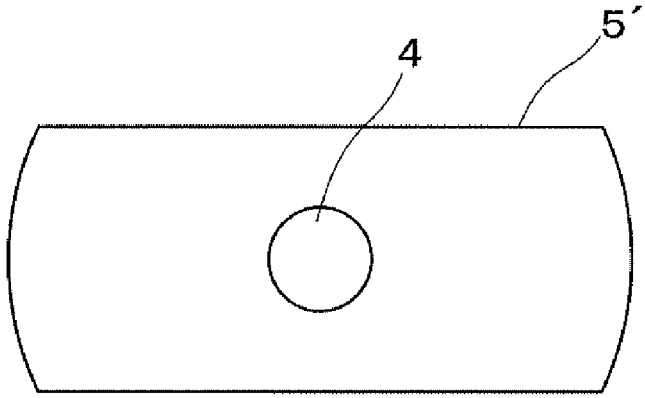
FIG. 3 is a plan view of other example of the stirring blade of the sealed stirring apparatus.

Note that, as shown in FIG. 3, a stirring blade composed of a laterally long sheet-shaped member 5' or a rectangular sheet-shaped member formed by cutting off upper and lower portions of a disc blade may be used in place of the stirring blade 5.

Further, the stirring vessel 2 may be made airtight by covering the upper end opening portion thereof by a bellows in place of the diaphragm 3.

Embodiment 2

An embodiment 2 of the invention will be explained referring to FIGS. 8 to 11.

Figure 8:
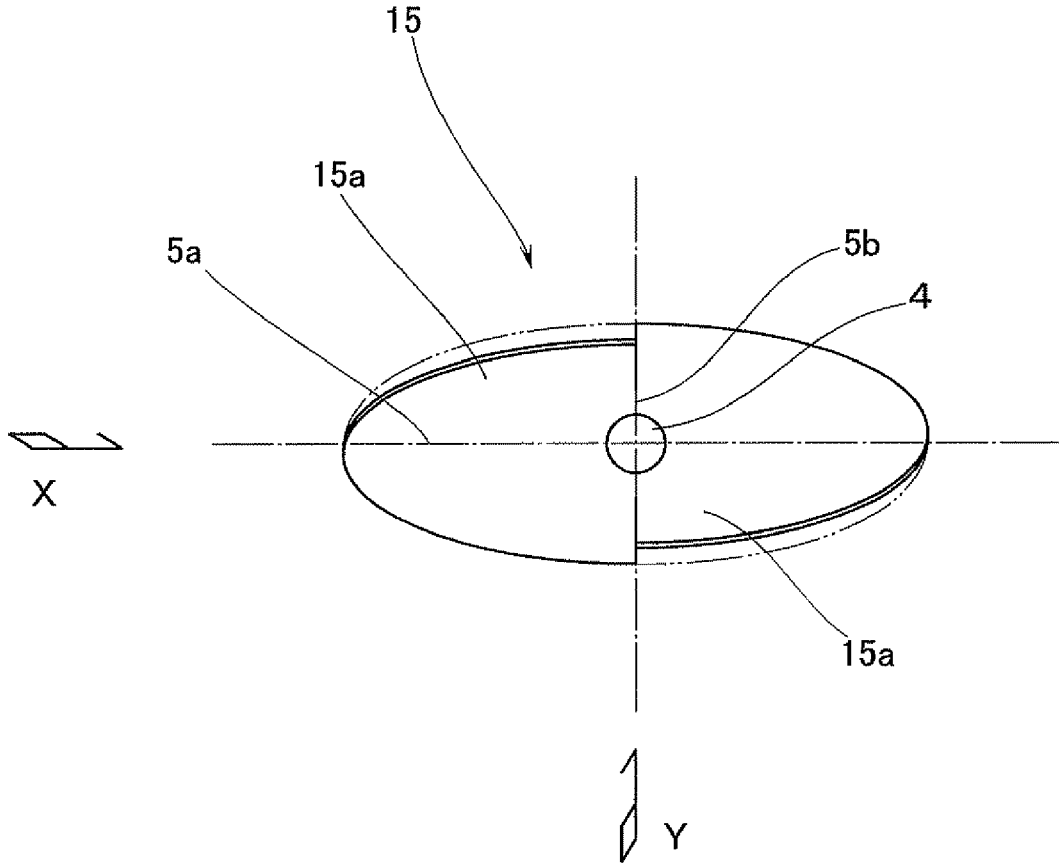
FIG. 8 is a plan view of a stirring blade of an embodiment 2 of the invention.
Figure 9:
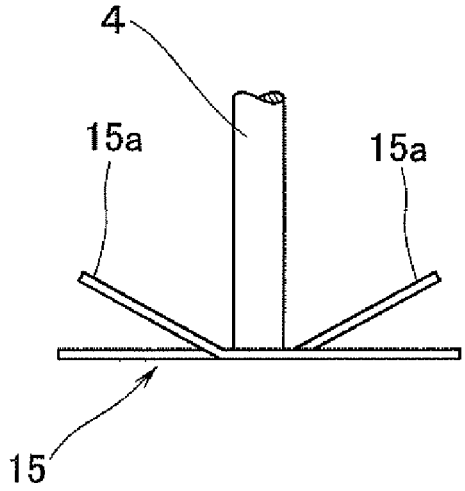
FIG. 9 is a fragmentary view of the stirring blade of the embodiment 2 in an X-direction in FIG. 8.

FIG. 8 is a plan view of a stirring blade 15 of the embodiment 2, and FIG. 9 a fragmentary view of the stirring blade 15 in an X-direction of FIG. 8.

Figure 10:
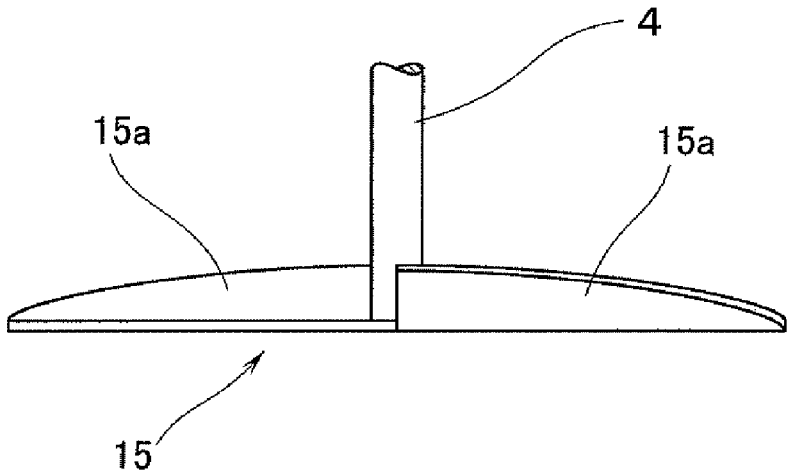
FIG. 10 is a fragmentary view of the stirring blade of the embodiment 2 in a Y-direction in FIG. 8.

FIG. 10 shows a fragmentary view of the stirring blade 15 in a Y-direction of FIG. 8.

The stirring blade 15 is composed of an oval sheet-shaped member. Portions of the oval stirring blade 15, which are partitioned by a major axis line 5*a* and a minor axis line 5*b* passing through a center thereof, are slit along the minor axis line 5*b* as well as a pair of diagonal portions which are not disposed side by side are bent obliquely upward along the major axis line 5*a* to thereby form the stirring blade 15 having tilt blade portions 15*a*, 15*a*.

The tilt blade portions 15*a* have a bending angle of, for example, 30°.

Figure 11:
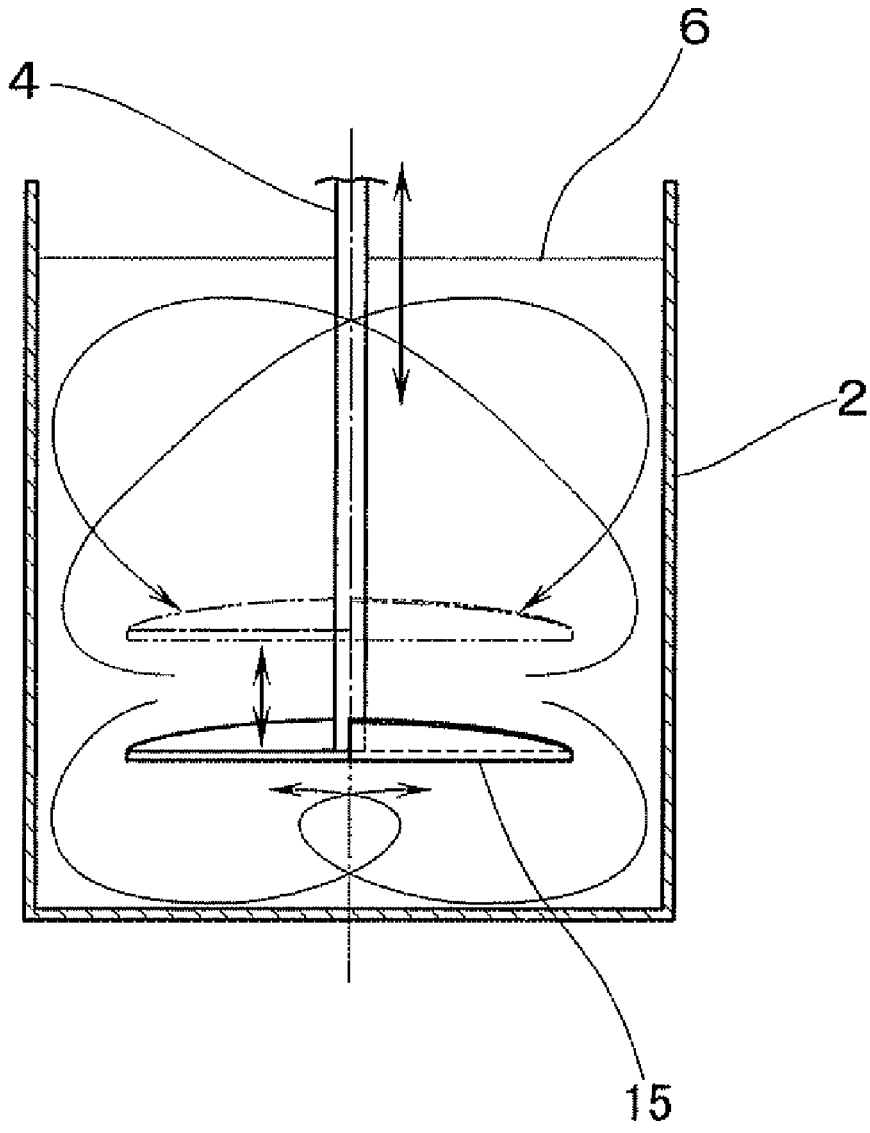
FIG. 11 is an explanatory view showing a flow pattern of an up/down vibration stirring using the stirring blade of the embodiment 2.

FIG. 11 shows a flow pattern of an up/down vibration stirring in a stirring apparatus using the stirring blade 15 of the embodiment 2.

Since an up/down convection, which moves up and down while swirling in an overall stirring vessel, is generated by disposing the tilt blade portions 15*a*, an advantage of forming a large circulating flow in the vessel can be obtained.

Note that although the tilt blade portions 15*a*, 15*a* are bent obliquely upward, they may be bent obliquely downward.

Embodiment 3

An embodiment 3 of the invention will be explained referring to FIGS. 12 to 14.

Figure 12:
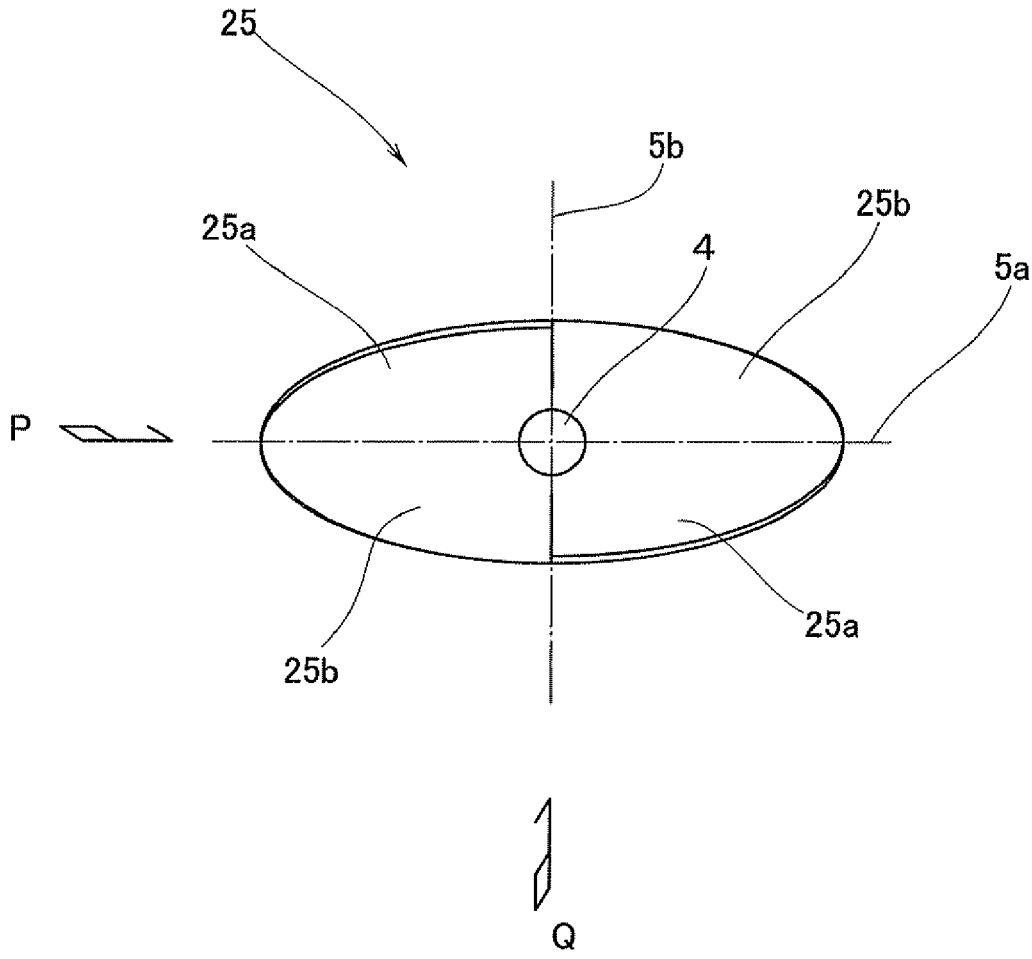
FIG. 12 is a plan view of a stirring blade of an embodiment 3 of the invention.
Figure 13:
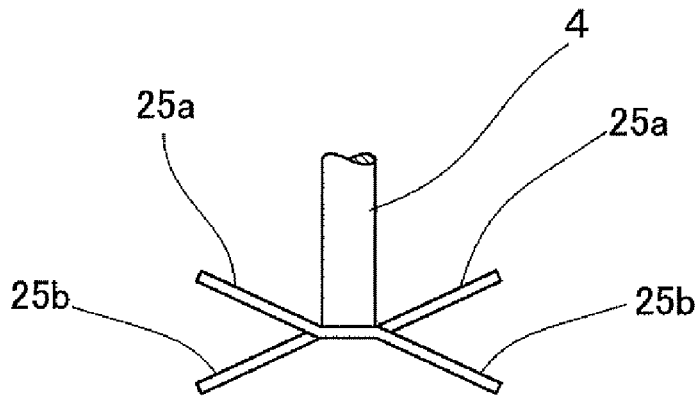
FIG. 13 is a fragmentary view of the stirring blade of the embodiment 3 in a P-direction in FIG. 12.
Figure 14:
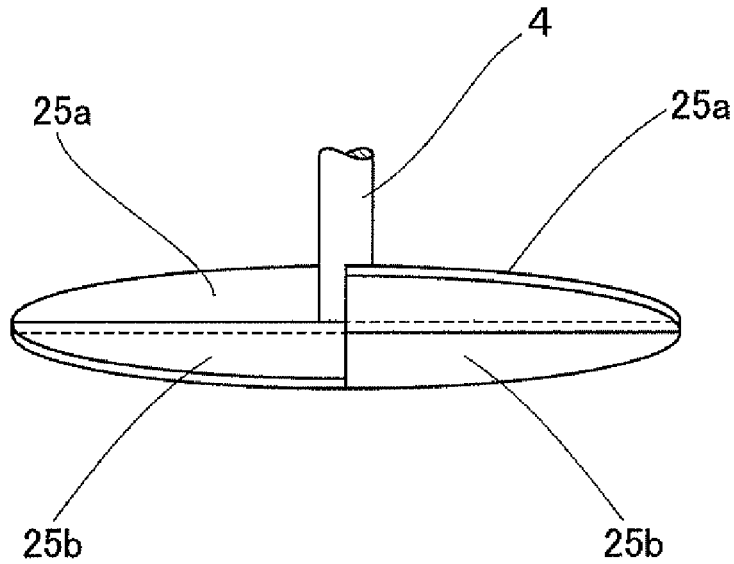
FIG. 14 is a fragmentary view of the stirring blade of the embodiment 3 in a Q-direction in FIG. 12.

FIG. 12 shows a plan view of a stirring blade 25 of the embodiment 3, FIG. 13 shows a fragmentary view of the stirring blade 25 in a P-direction of FIG. 12, and FIG. 14 shows a fragmentary view of the stirring blade 25 in a Q-direction of FIG. 12.

The stirring blade 25 is composed of an oval sheet-shaped member. Portions of the oval stirring blade 25, which are partitioned by a major axis line 5*a* and a minor axis line 5*b* passing through a center thereof, are slit along the minor axis line 5*b* as well as two pairs of diagonal portions which are not disposed side by side are bent obliquely upward or obliquely downward, respectively along the major axis line 5*a*. With this arrangement, the stirring blade 25 has such a structure that portions disposed side by side across the major axis line 5*a* or the minor axis line 5*b* have tilt blade portions 25*a*, 25*b* projecting up and down in opposite directions each other.

An excellent mixing performance can be achieved as well as a driving force can be saved also when an up/down vibration stirring is performed by a stirring apparatus using the stirring blade 25 of the embodiment 3.

The stirring blade and the sealed stirring apparatus of the invention are used mainly for a stirring of a culture liquid in a field of medicine, a stirring in a filed of food, and the like.

What is claimed is:

1. A stirring blade comprising:

a drive shaft reciprocating up and down; and a blade member coupled with and fixed to a lower end surface portion of the drive shaft so as to be orthogonal thereto and composed of a laterally long sheet-shaped member having a major axis and a minor axis passing through a center thereof, wherein diagonal portions of the blade member, which are partitioned by a major axis line and a minor axis line passing through a center thereof and are not disposed side by side, are slit along the minor axis line and are bent obliquely upward or obliquely downward along the major axis line to thereby form the blade member having at least one tilt blade portion.

2. A stirring blade according to claim 1, wherein the blade member is formed in a rectangular shape, a long circular shape, or an oval shape.

3. A sealed stirring apparatus comprising:

a stirring vessel;

a diaphragm or a bellows movable up and down and disposed to an upper surface portion of the stirring vessel to airtightly cover the upper surface portion;

a drive shaft fixed and vertically disposed to the diaphragm or the bellows so as to pass therethrough; and a stirring blade coupled with and fixed to a lower end portion of the drive shaft so as to be orthogonal thereto is composed of a laterally long sheet-shaped member having a large diameter and a small diameter passing through a center thereof, wherein diagonal portions of the stirring blade, which are partitioned by a major axis line and a minor axis line passing through a center thereof and are not disposed side by side, are slit along the minor axis line and are bent obliquely upward or obliquely downward along the major axis line to thereby form the stirring blade having at least one tilt blade portion, wherein an inside of the stirring vessel is stirred by moving the stirring blade up and down.

4. A sealed stirring apparatus according to claim 3, wherein the stirring blade is formed in a rectangular shape, a long circular shape, or an oval shape.

* * * * *